US005984384A

United States Patent [19]

Hamaguchi et al.

[11] Patent Number: 5,984,384

[45] Date of Patent: Nov. 16, 1999

[54] VEHICLE DOOR LATCH DEVICE WITH SELF-CANCELLING MECHANISM

[75] Inventors: Osamu Hamaguchi; Yoshihito Gomi, both of Yamanashi-ken, Japan

[73] Assignee: Mitsui Kinzoku Kogyo Kabushiki Kaisha, Tokyo, Japan

[21] Appl. No.: 09/163,471

[22] Filed: Sep. 30, 1998

[30] Foreign Application Priority Data

Oct. 1, 1997 [JP] Japan ..... 9-284368

[51] Int. Cl.[6] ..... E05C 3/06

[52] U.S. Cl. ..... 292/216; 292/DIG. 23; 292/DIG. 26; 292/336.3

[58] Field of Search ..... 292/201, 216, 292/336.3, DIG. 23

[56] References Cited

U.S. PATENT DOCUMENTS 5,015,020 5/1991 Mizuke ..... 292/216
5,154,457 10/1992 Watanabe ..... 292/216
5,181,754 1/1993 Shibata .
5,531,488 7/1996 Yoshikuwa et al. ..... 292/216
5,615,564 4/1997 Inoue ..... 292/216
5,794,992 8/1998 Yoneyama ..... 292/216
5,833,282 11/1998 Ikeda ..... 292/216
5,896,767 4/1999 Gomi ..... 292/216

*Primary Examiner*—Steven Meyers
*Assistant Examiner*—Teri Pham
*Attorney, Agent, or Firm*—Browdy and Neimark

[57] ABSTRACT

A vehicle door latch device comprises a longitudinal open link having an upper end connected to an open lever and a lower end connected to a lock lever. The open link is displaced into a locked position when it moves toward an exterior side of a latch body and is not overlapped with a raised portion of the latch body. A self-canceling lever is attached to the latch body by a first shaft and has a first arm connected to an ratchet pin and a second arm extending toward the open link. The second arm restores the open link to an unlocked position by when a ratchet is rotated by a contact with a latch. The first shaft is located on an exterior side of the ratchet pin. The second arm is overlapped with the open link when the open link is in the locked position.

3 Claims, 10 Drawing Sheets

1
6
7
11
10
4
13
14A
8
20
16
3
21
14
17
15
12
19
18
9
5
INTERIOR SIDE
EXTERIOR SIDE

VEHICLE DOOR LATCH DEVICE WITH SELF-CANCELLING MECHANISM

BACKGROUND OF THE INVENTION

1. Field of the Invention

The present invention relates to a vehicle door latch device, and more specifically, relates to a latch device provided with a self-canceling mechanism which is capable of restoring a vehicle door (latch device) from a locked state to an unlocked state so as to prevent the door from being unintentionally locked, when closing the door. The self-canceling mechanism is also used as a mechanism composing a part of a one-motion mechanism which is capable of opening the door and restoring the latch device from the locked state to the unlocked state at the same time when an interior opening handle of the door is operated during the locked state.

2. Description of the Related Art

Referring to FIGS. 10 and 11, a conventional vehicle door latch device comprises: a ratchet A for holding an engagement between a latch and a striker; an outer open lever C connected to an exterior opening handle B of a door; a lock lever D switching the latch device between a locked state and an unlocked state; an open link E provided between the open lever C and the lock lever D; a ratchet lever (self-cancel lever) F connected to the ratchet A; an inner open lever H rotated by an interior opening handle G of the door; and a horizontal raised portion J formed on a latch body or housing of the latch device and receiving the striker when closing the door. The open link E is displaced, in FIG. 11, between a locked position shown in a solid line near the center of the latch body and an unlocked position shown in a dotted line a little approaching the exterior side of the latch body by the rotation of the lock lever D. The link E has a first bent portion L which is engageably opposed to a projection K of the self-canceling lever F when the link E is in the unlocked position. The inner open lever H indirectly has a second bent portion M which is engageably opposed to the projection K. The self-canceling lever F has a tip end P which is engageably opposed to a third bent portion N formed on the open link E.

When closing the door in the locked state, the ratchet A is rotated by the contact with the latch to rotate the self-canceling lever F counterclockwise in FIG. 11, and the tip end P of the self-canceling lever F then comes into contact with the third bent portion N of the open link E and pushes the link E toward the exterior side of the latch body. Thereby, the latch device is restored from the locked state to the unlocked state before the door is completely closed. This is a self-canceling mechanism of the latch device.

Further, when the interior opening handle G is operated to open the door in the door closed and locked states, the second bent portion M comes into contact with the projection K of the self-canceling lever F through the inner open lever H to rotate the self-canceling lever F counterclockwise in FIG. 11. Consequently, the ratchet A which is connected to the lever F is moved and separated from the latch so as to open the door. At the same time, the open link E is restored to the unlocked position by the contact with the tip end P of the self-canceling lever F, as mentioned above. This is a one-motion mechanism of the latch device.

A problem to be solved of the conventional latch device is in that the open link E is extending from the open lever C to the lock lever D over the horizontal raised portion J formed on the latch body, so that the link E and the raised portion J are overlapped, thus creating a problem of increased thickness of the latch device.

On the other hand, U.S. Pat. No. 5,181,754 discloses another latch device which solves the above problem by locating an open link (33) to an exterior side of a horizontal raised portion (13). In this latch device, the open link (33) is displaced into the locked position when it is substantially shifted to the exterior side of the latch body (1). This is an opposite structure of the former prior art latch device shown in FIGS. 10 and 11. The reason why the locked position and the unlocked position of the open link are opposite, is to make it possible to provide the open link on the exterior side of the raised portion without increasing the width of the latch body. If the unlocked position of the open link (33) is made to be on the exterior side of the locked position, the position of the pin (10) which is equivalent to the projection K of the former prior art should be also moved to the exterior side, so that the width of the latch body is increased. Because of such a difference in arrangement, it becomes impossible to use the self-canceling lever used in the former latch device, in the latter latch device. Therefore, the latter latch device has adopted a key-less-lock mechanism having the same object as the self-canceling mechanism, but since there is a difference in the operating method between the key-less-lock mechanism and the self-canceling mechanism, confusion has been given to the user in some cases.

SUMMARY OF THE INVENTION

Accordingly, an object of the present invention is to provide a self-canceling mechanism to a latch device in which an open link is not overlapped with a horizontal raised portion.

DESCRIPTION OF THE PREFERRED EMBODIMENT

Figure 1:
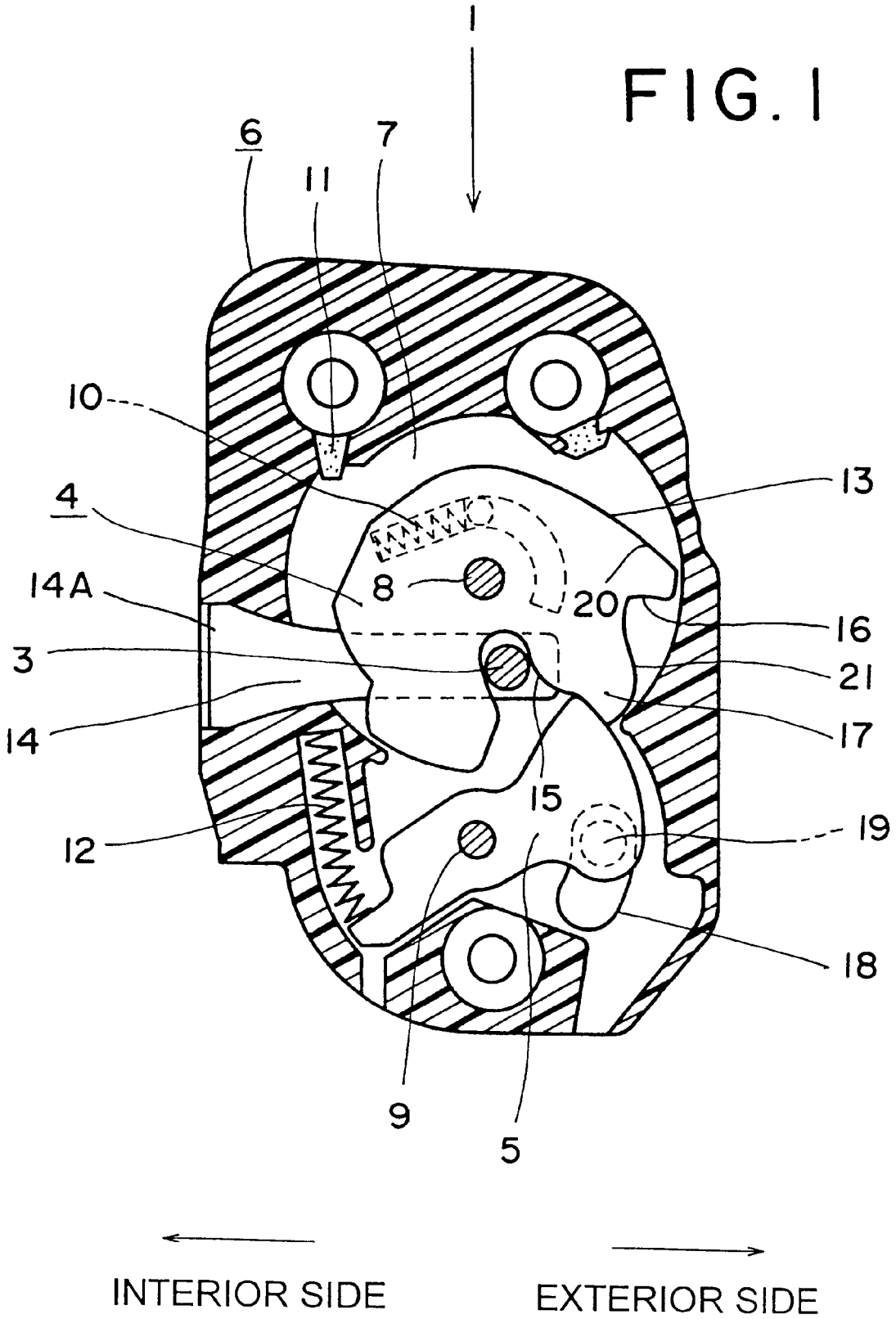
FIG. 1 is a vertical cross sectional front view of a latch device according to the present invention.
Figure 2:
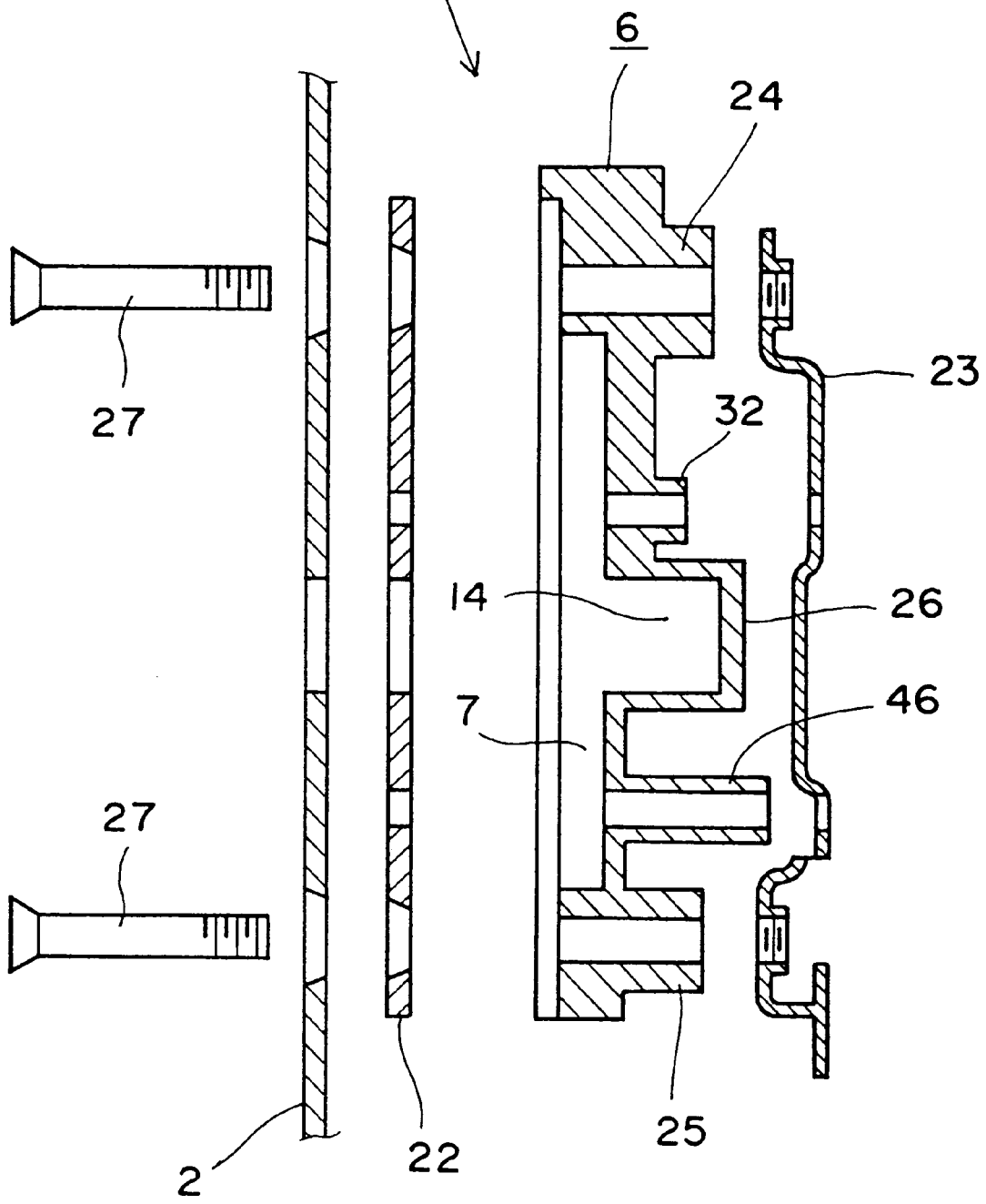
FIG. 2 is a vertical cross sectional view showing the relation between a latch assembly of the latch device and a door panel.
Figure 3:
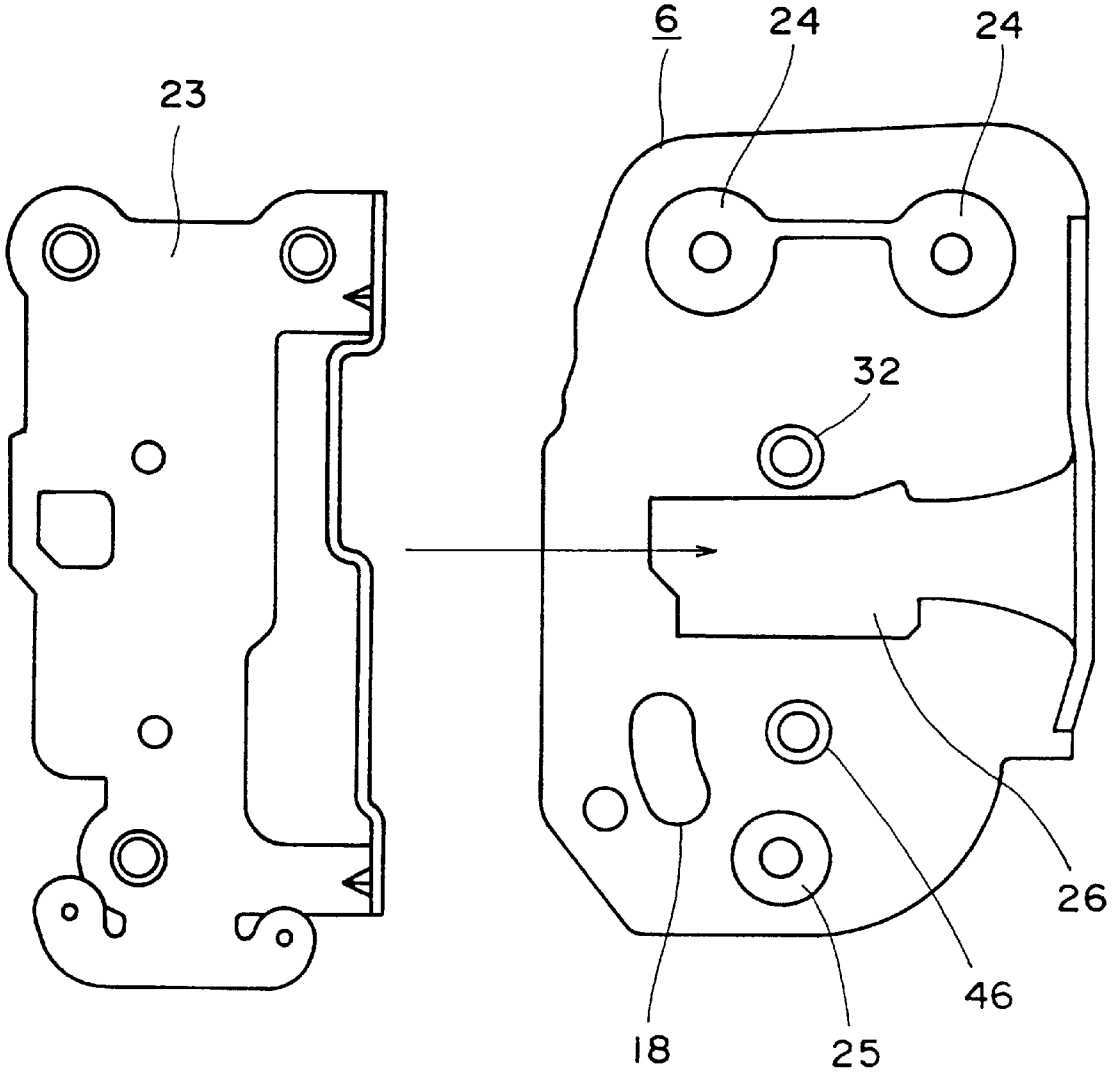
FIG. 3 is a rear view of a latch body and a back plate of the latch assembly.
Figure 4:
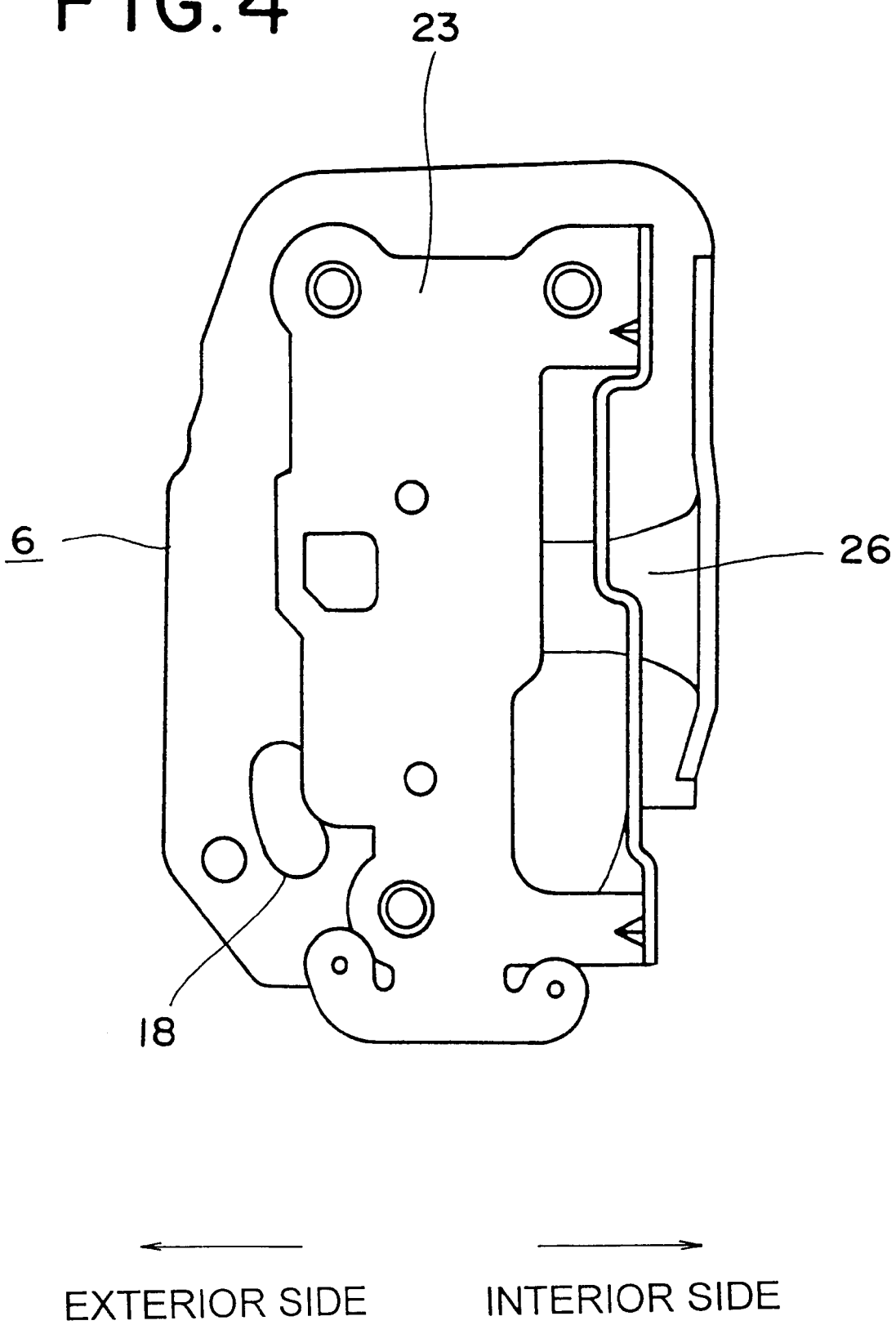
FIG. 4 is a rear view showing a state where the back plate is mounted to the latch body.

Referring now to FIGS. 1 and 2, a vehicle door latch device according to the present invention comprises a latch assembly 1 adapted to be fixed to a metal door panel 2 of a vehicle door, and a striker 3 adapted to be fixed to a vehicle body (not shown). The latch assembly 1 includes a latch 4 adapted to be engaged with the striker 3 when the door is moved toward a door-closed position, and a ratchet 5 for holding the engagement between the latch 4 and the striker 3. The latch 4 is rotatably received at an upper portion in a recess 7 formed on a front side of a latch body 6 made of synthetic resin by means of a latch shaft 8, and the ratchet 5 is rotatably received at a lower portion in the recess 7 by means of a ratchet shaft 9.

The latch 4 is urged clockwise in FIG. 1 by an elasticity of a latch spring 10. When the door is in a door-opening position, the latch 4 is located in an unlatched position in which the latch 4 is brought into contact with a damper 11 fixed to the latch body 6. The ratchet 5 is urged counterclockwise in FIG. 1 by an elasticity of a ratchet spring 12. The ratchet 5 touches an unlatched portion 13 formed on the periphery of the latch 4, when the door is in the opening position. When the door is moved toward the closed position from the opening position, the striker 3 enters into a horizontal passage 14 formed in the latch body 6 and comes into contact with a U-shaped groove 15 of the latch 4, thereby the latch 4 is rotated counterclockwise against the elasticity of the latch spring 10. When the latch 4 is rotated to a half-latched position from the unlatched position, the ratchet 5 is engaged with a first step 16 of the latch 4 by the elasticity of the ratchet spring 12, and when the latch 4 comes to an full-latched position shown in FIG. 1, the ratchet 5 is engaged with a second step 17 of the latch 4, thereby the door is kept in the closed position.

The ratchet 5 has a ratchet pin 19 which is projected to a rear side of the latch body 6 through an opening 18 of the latch body 6. The pin 19 is positioned at an upper portion in the opening 18 as shown in FIG. 1 when the ratchet 5 is brought into contact with the unlatched portion 13 or is engaged with one of the steps 16 and 17, and the pin 19 is moved downward within the opening 18 when the ratchet 5 is brought into contact with a first large diameter portion 20 of the latch 4 formed between the unlatched portion 13 and the first step 16, or a second large diameter portion 21 of the latch 4 formed between the first step 16 and the second step 17.

As shown in FIG. 2, a metal cover plate 22 for substantially covering the recess 7 of the latch body 6 is mounted to the front side of the latch body 6, and a metal back plate 23 is mounted to the rear side of the latch body 6. The back plate 23 has an approximately flat portion, upper and lower portions of which touch upper and lower bosses 24, 25 formed integrally with the latch body 6, respectively, and a middle portion of the flat portion comes into contact with a horizontal raised portion 26 formed in latch body 6 in order to define the horizontal passage 14. The latch assembly 1 which has the latch body 6 and the plates 22, 23 is fixed to the metal door panel 2 of the door by screws 27 inserted into the bosses 24, 25.

Figure 7:
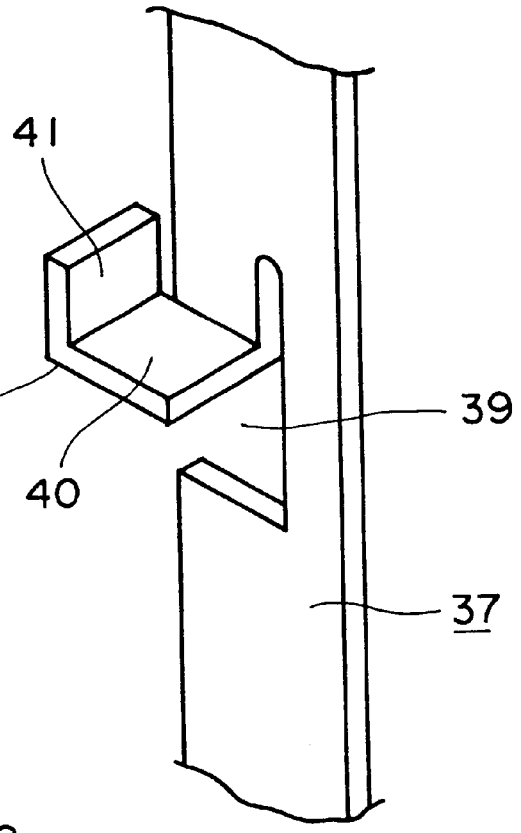
FIG. 7 is a partly enlarged perspective view of an open link of the latch assembly.

Between the latch body 6 and the back plate 23 at a position above the horizontal raised portion 26, an outer open lever 29 adapted to be connected to an exterior opening handle 28 of the door and an inner open lever 31 adapted to be connected to an interior opening handle 30 of the door are provided. The open levers 29, 31 are rotatably attached on a first boss portion 32 of the latch body 6 into which the latch shaft 8 is inserted. The outer open lever 29 is urged clockwise in FIG. 5 by an elasticity of a return spring 33, and an interior end portion 34 of the outer open lever 29 comes into contact with the horizontal raised portion 26 when the exterior opening handle 28 is not operated. The inner open lever 31 has a bent tab 35 at an exterior upper side thereof which abuts against the outer open lever 29 so that the inner open lever 31 rotates the outer open lever 29 counterclockwise by the contact of the bent tab 35 with the outer open lever 29 when the interior opening handle 30 is operated. To an exterior arm 36 of the outer open lever 29 extending toward the exterior side of the latch body 6, an upper end of an open link 37 is connected by means of a pin 38. The open link 37 is positioned on the exterior side of the latch body 6 so that the open link 37 is not overlapped with the horizontal raised portion 26 in a front-and-rear direction of the latch body 6. A notch portion 39 is formed at a middle portion of the open link 37. As shown in FIG. 7, at an edge portion of the notch portion 39 is formed an inverted L-shaped bent portion 42 which has a horizontal abutting surface 40 and a vertical abutting surface 41. It is noted that the interior and the exterior sides of the latch body are defined by the position of an entrance or opening 14 A of the horizontal passage 14 into which the striker 3 enters when the door is closed, which entrance 14A must be formed on the interior side of the latch body 6.

Between the latch body 6 and the back plate 23 at a position below the horizontal raised portion 26, a lock lever 44 adapted to be connected to an inside lock button 43 of the door is provided. The lock lever 44 is rotatably attached on a second boss portion 45 of the latch body 6 into which the ratchet shaft 9 is inserted. A right or interior end of a connecting link 47 is connected to a lower arm 46 of the lock lever 44 extending downward by mean of a pin 48, and a left or exterior end of the connecting link 47 is connected to a lower end of the open link 37 by a pin 49.

Figure 5:
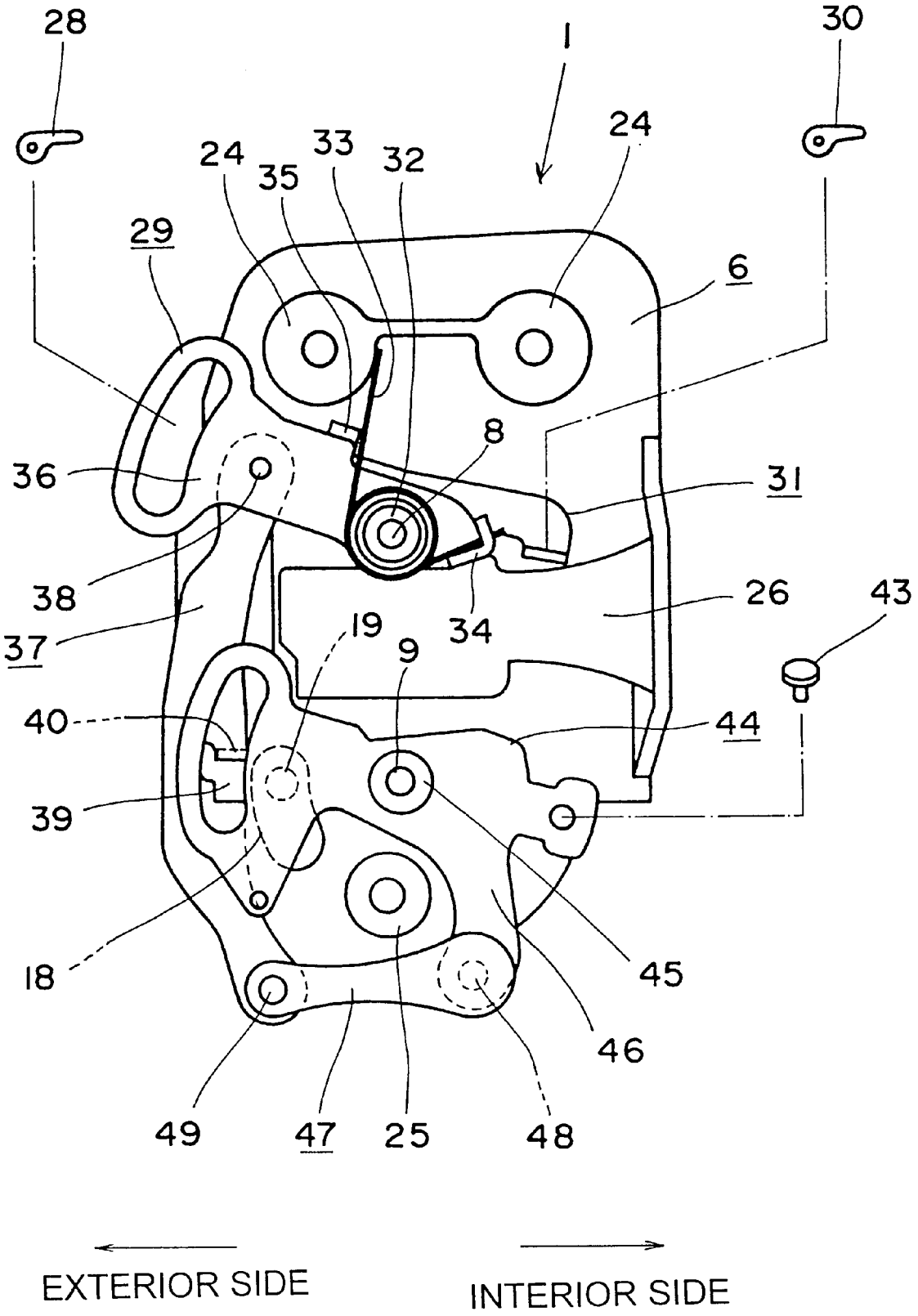
FIG. 5 is a rear view of the latch assembly in a locked sate, in which the back plate is removed.
Figure 6:
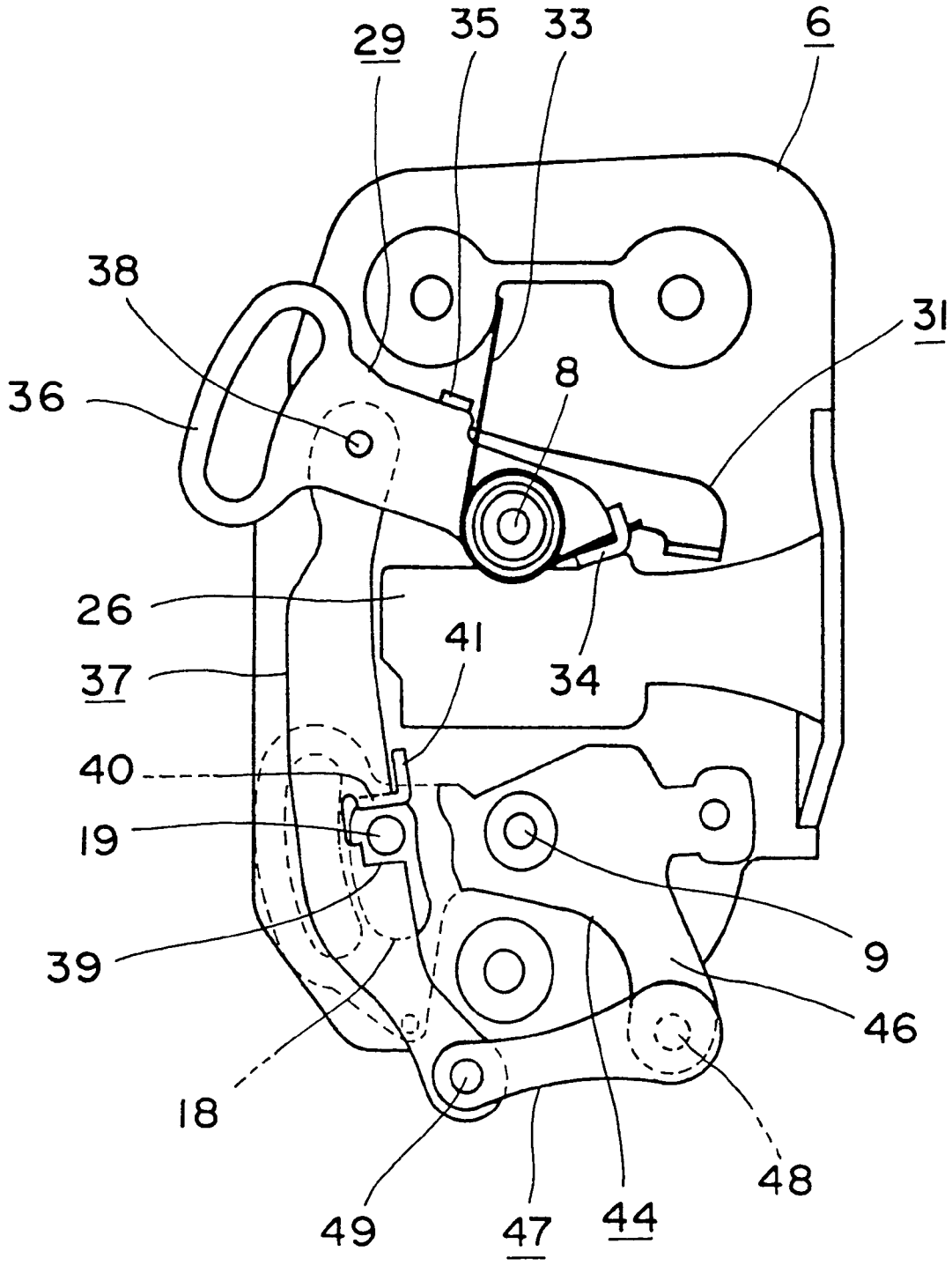
FIG. 6 is a rear view of the latch assembly in an unlocked state, which the back plate is removed.

The open link 37 is displaced between an unlocked position shown in FIG. 6 and a locked position shown in FIG. 5 through the connecting link 47 by rotating the lock lever 44 around the ratchet shaft 9 with the inside lock button 43. The open link 37 is displaced into the locked position when the lower end of the open link 37 is substantially shifted toward the exterior side of the latch body 6, and the open link 37 is displaced into the unlocked position when the lower end of the open link 37 is substantially shifted toward the interior side of the latch body 6. When the open link 37 is in the unlocked position, the horizontal abutting surface 40 is engageably opposed to the ratchet pin 19. Thus, when the open link 37 is caused to be moved downward by the turn of the outer open lever 29, the abutting surface 40 comes into contact with the ratchet pin 19 to rotate the ratchet 5 against the elasticity of the ratchet spring 12, thereby the ratchet 5 is disengaged from the latch 4 and the latch 4 is returned to the unlatched position so as to open the door. When the open link 37 is shifted to the locked position by the turn of the lock lever 44, the horizontal abutting surface 40 becomes disengageable with the ratchet pin 19. Accordingly, the downward movement of the open link 37 cannot rotate the ratchet 5, so that the door cannot be opened.

Figure 9:
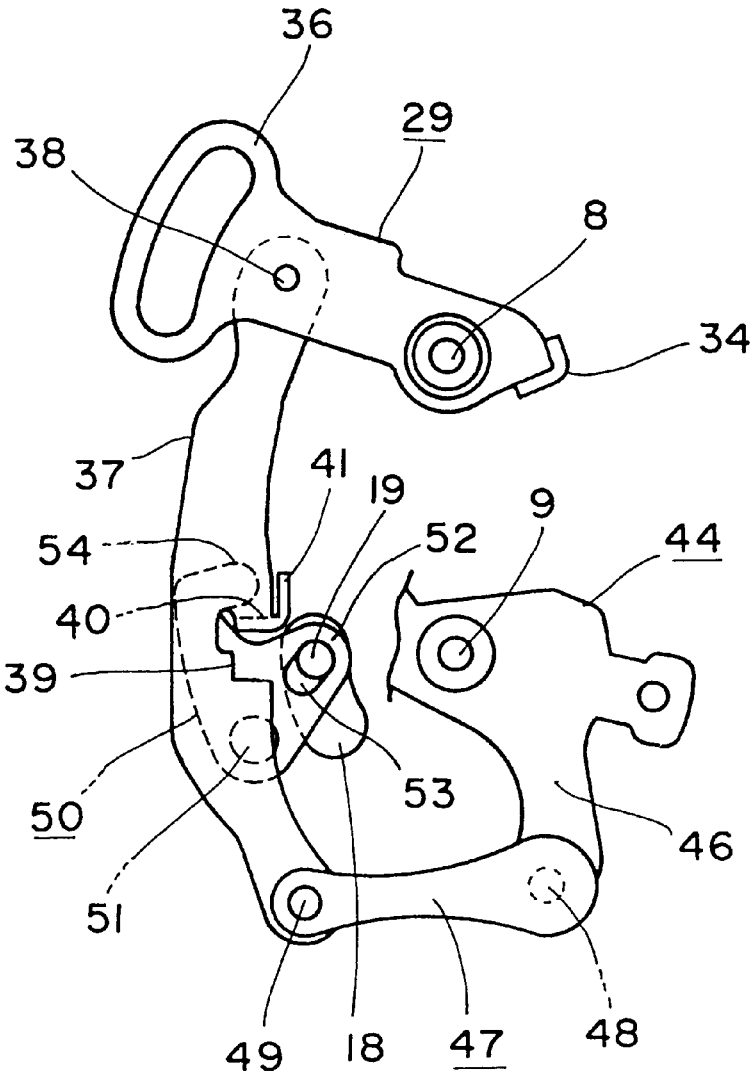
FIG. 9 is a schematic rear view explaining a self-canceling mechanism of the latch assembly.
Figure 8:
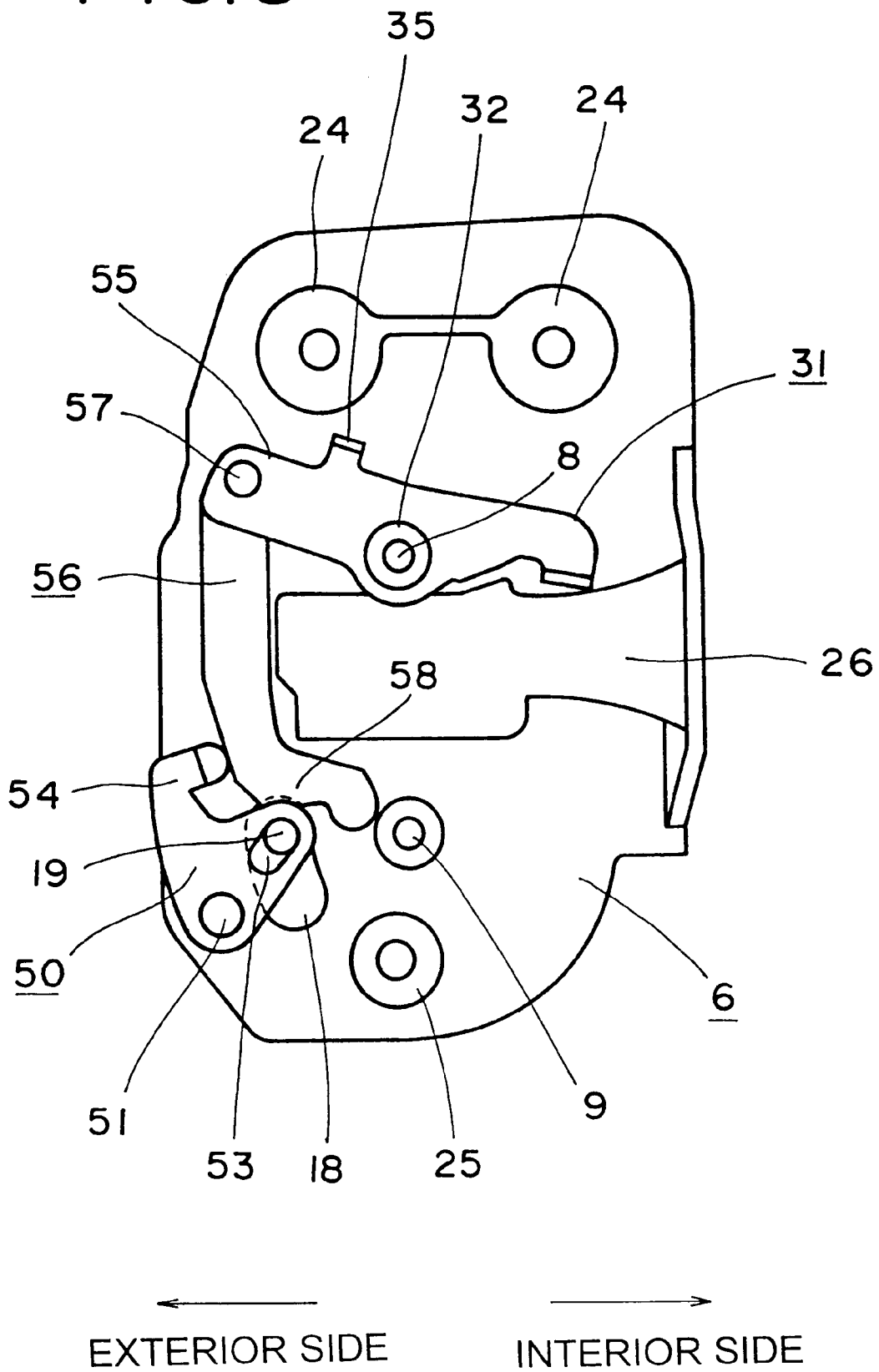
FIG. 8 is a rear view showing a state where an inner open lever, a one-motion link, and a self-canceling lever are attached to the rear side of the latch body.
Figure 10:
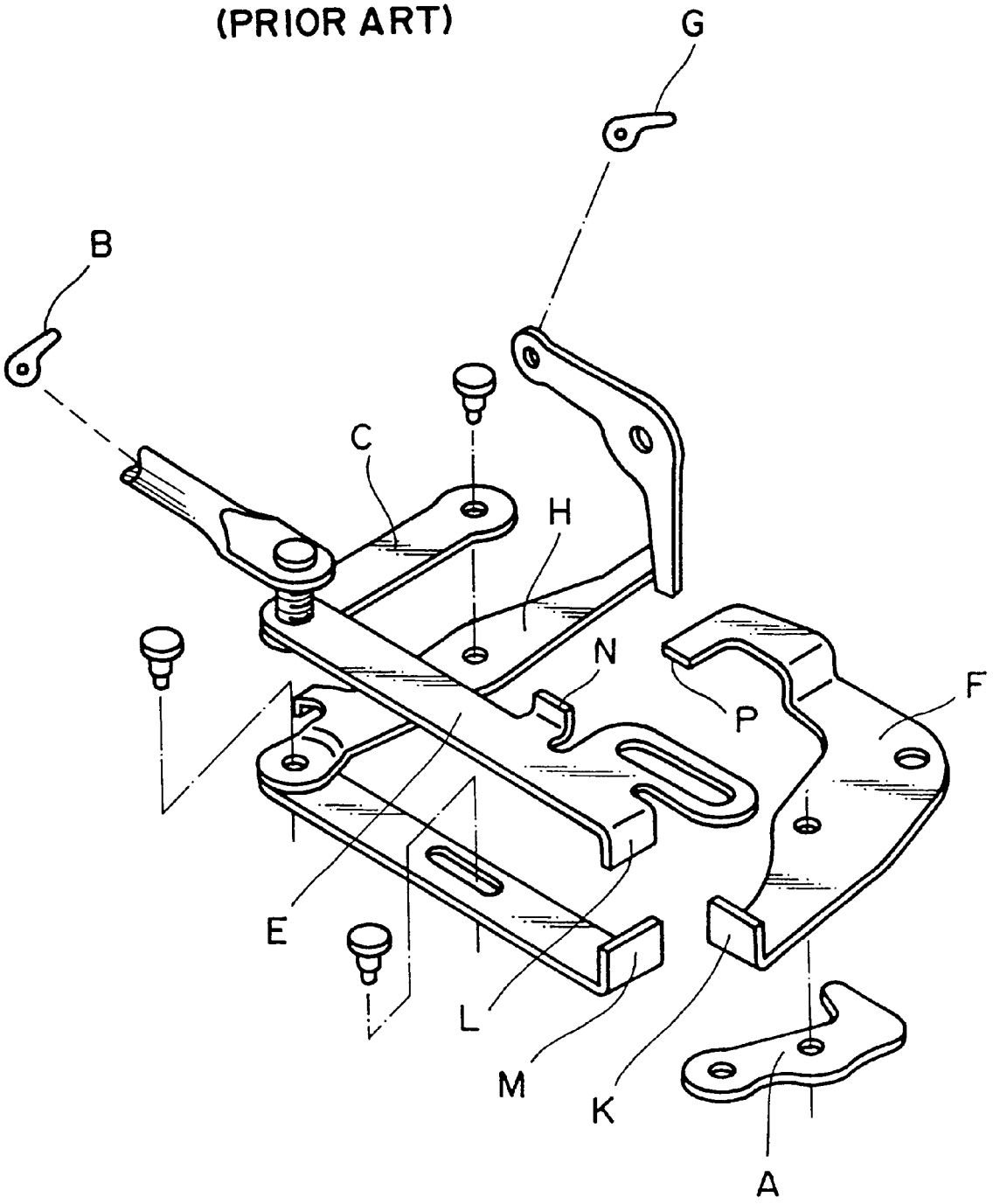
FIG. 10 (PRIOR ART)
FIG. 10 and FIG. 11 are a view of a well known example.
Figure 11:
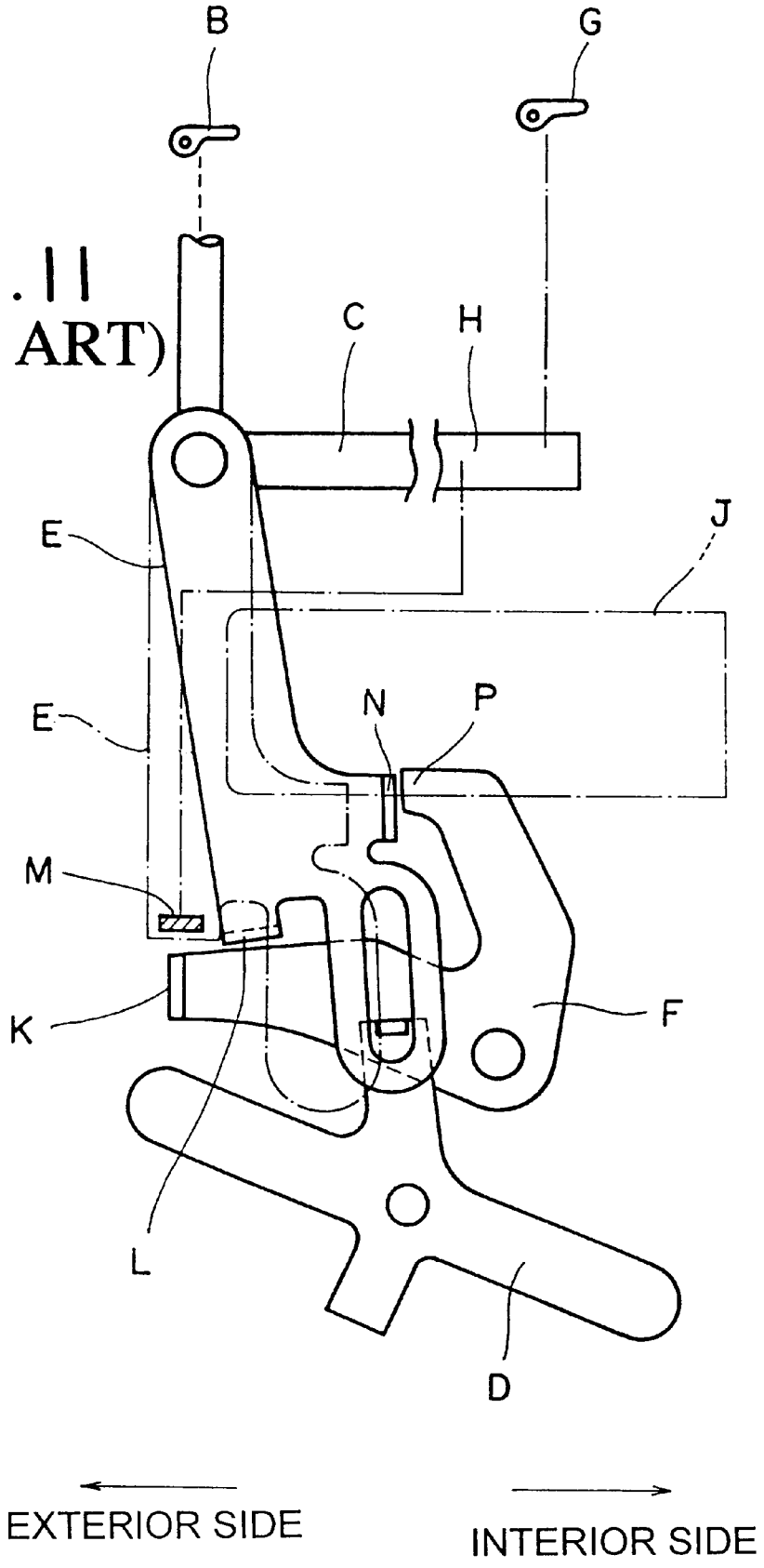
FIG. 11 (PRIOR ART)

As shown in FIG. 8, on the lower exterior side of the rear side of the latch body 6, a self-canceling lever 50 is rotatably attached by a pin portion 51. By the way, the self-canceling lever 50 is not illustrated in FIGS. 5 and 6 for simplifying the drawings. The self-canceling lever 50 has an approximate C-shape, and a first arm 52 thereof has an elongated hole 53 with which the ratchet pin 19 is slidably engaged. A second arm 54 of the self-canceling lever 50 is extended upwardly and then angled to extend toward the vertical abutting surface 41 of the open link 37. As mentioned above, the ratchet pin 19 is positioned at the upper portion within the opening 18 in the door-opening state by the contact between the ratchet 5 and the unlatched portion 13 of the latch 4. In this opening state, when the opening link 37 is substantially shifted toward the exterior side of the latch body and moved into the locked position by the turn of the lock lever 44, the vertical abutting surface 41 of the open link 37 is approaching the second arm 54 of the self-canceling lever 50 as shown in FIG. 9, and when closing the door in the locked state of FIG. 9, the latch 4 is rotated from the unlatched position toward the full-latched position by the contact with the striker 3, and the ratchet 5 is then pushed downward by the contact with the large diameter portion 20 of the latch 4, thereby the ratchet pin 19 is moved downward in the opening 18. Then, the self-canceling lever 50 is rotated clockwise around the pin 51 in FIG. 9, and the second arm 54 of the self-canceling lever 50 is brought into contact with the vertical abutting surface 41 to push the open link 37 toward the interior side, and consequently, the open link 37 is restored to the unlocked position. Accordingly, the door is closed in the unlocked state. This is the self-canceling mechanism of the present invention.

In order to stop the function of the self-canceling mechanism, the door is closed while moving the open link 37 downward by the operation of the exterior opening handle 28 in the locked state of FIG. 9. Consequently, the vertical abutting surface 41 of the open link 37 is separated from the second arm 54 of the self-canceling lever 50, and therefore, the self-canceling mechanism does not operate, and the door can be closed in the locked state.

As shown in FIG. 8, to an exterior arm 55 of the inner open lever 31, an upper end of a one-motion link 56 is connected by a pin 57. The one-motion link 56 (not shown in FIGS. 5, 6) is positioned between the open link 37 and latch body 6, and is positioned on the exterior side of the latch body 6 from the horizontal raised portion 26 similarly to the open link 37, and is not overlapped with the horizontal raised portion 26 in the front-and-rear direction of the latch body 6. A lower end 58 of the one-motion link 56 is engageably opposed to the ratchet pin 19. Thus, when the one-motion link 56 is moved downward, in the locked and closed states, by rotating the inner open lever 31 with the interior opening handle 30, the lower end 58 of the one-motion link 56 comes into contact with the ratchet pin 19 to rotate the ratchet 5 against the elasticity of the ratchet spring 12, thereby the ratchet 5 is disengaged from the latch 4 and the latch 4 is returned to the unlatched position so as to open the door. At the same time, the self-canceling lever 50 is rotated by the downward movement of the ratchet pin 19, and the open link 37 is restored to the unlocked position by the contact between the second arm 54 and the vertical touching surface 41. This is the one-motion mechanism of the present invention.

By the way, when the one-motion mechanism is not adopted, the inner open lever 31 and the one-motion link 56 become unnecessary. In this case, the interior opening handle 30 may be connected to the outer open lever 29.

ADVANTAGE

In the present invention, the pin 51 which supports the self-canceling lever 50 is positioned on the exterior side of the latch body 6 from the ratchet pin 19, and therefore, the second arm 54 of the self-canceling lever 50 can move from the exterior side of the latch body 6 to the interior side when the ratchet 9 is rotated by the contact with the large diameter portion 20 of the latch 4. Accordingly, a self-canceling mechanism can be added to the latch device having the open link 37 which is shifted to the locked position when it moves to the exterior side of the latch body 6.

Furthermore, in the present invention, since the self-canceling lever 50 is substantially overlapped with the open link 37 in the front-and-rear direction of the latch body 6 as shown in FIG. 9, the width of the latch assembly 1 is not increased.

What is claimed is:

1. A vehicle door latch device comprising:

a latch body fixable to a vehicle door and provided on a front side thereof with a horizontal passage into which a striker fixed to a vehicle body enters when closing the door and on a rear side thereof with a horizontal raised portion for defining the horizontal passage, said latch body having an interior side in which an entrance of the horizontal passage is formed and an exterior side opposite to the interior side;

a latch rotatably attached to the front side of the latch body and engageable with the striker;

a ratchet rotatably attached to the front side of the latch body for holding an engagement between the latch and the striker by engaging with the latch, and having a ratchet pin projecting to the rear side of the latch body;

an open lever connectable to an exterior opening handle of the door and rotatably attached to the rear side of the latch body at a position above the horizontal raised portion, said open lever having an exterior arm extending toward the exterior side of the latch body;

a lock lever connectable to an inside lock button of the door and rotatably attached to the rear side of the latch body at a position below the horizontal raised portion;

an elongated longitudinal open link having an upper end connected to the exterior arm of the open lever and a lower end connected to the lock lever, and displaceable between an unlocked position in which the open link is engaged with the ratchet pin to release the ratchet from the latch by an opening operation of the opening handle and a locked position in which the open link is disengaged from the ratchet pin when the lock lever rotates, said open link being located on the exterior side of the latch body so that the open link is not overlapped with the horizontal raised portion in a front-and-rear direction of the latch body;

a self-canceling lever rotatably attached to the rear side of the latch body by a first shaft, and having a first arm connected to the ratchet pin and a second arm extending toward the open link, said open link having a means for allowing said second arm to restore the open link from the locked position to the unlocked position by coming into contact with the open link when the ratchet is rotated by a contact with the latch;

wherein said open link is displaced into the locked position when the lower end of the open link is substantially shifted toward the exterior side of the latch body, and said open link is displaced into the unlocked position when the lower end of the open link is substantially shifted toward the interior side of the latch body;

wherein said first shaft is located on an exterior side of the ratchet pin.

2. The vehicle door latch device according to claim 1, wherein said self-canceling lever is located between the latch body and the open link.

3. The vehicle door latch device according to claim 1, wherein said mean on said open link has, on an interior side thereof, a vertical abutting surface which is engageable with the second arm of the self-canceling lever, and wherein said second arm is arranged so as to be overlapped with the open link in the front-and-rear direction of the latch body when the open link is in the locked position.

* * * * *